US010630011B2

(12) United States Patent
Uhlemann et al.

(10) Patent No.: US 10,630,011 B2
(45) Date of Patent: Apr. 21, 2020

(54) PLUG CONNECTION OF CONDUCTIVE TRACKS OF AT LEAST TWO MUTUALLY SPACED CIRCUIT BOARDS, BY MEANS OF AT LEAST ONE PLUG CONNECTOR

(71) Applicant: AB ELEKTRONIK SACHSEN GMBH, Klingenberg (DE)

(72) Inventors: Lutz Uhlemann, Colmnitz (DE); Aldo Bojarski, Hockendorf (DE)

(73) Assignee: AB ELEKTRONIK SACHSEN GMBH, Klingenberg (DE)

( * ) Notice: Subject to any disclaimer, the term of this patent is extended or adjusted under 35 U.S.C. 154(b) by 0 days.

(21) Appl. No.: 16/315,337

(22) PCT Filed: Oct. 17, 2017

(86) PCT No.: PCT/EP2017/076443
§ 371 (c)(1),
(2) Date: Jan. 4, 2019

(87) PCT Pub. No.: WO2018/073228
PCT Pub. Date: Apr. 26, 2018

(65) Prior Publication Data

US 2019/0312368 A1 Oct. 10, 2019

(30) Foreign Application Priority Data

Oct. 18, 2016 (DE) ..... 10 2016 220 346

(51) Int. Cl.
*H01R 12/73* (2011.01)
*H01R 12/70* (2011.01)
(Continued)

(52) U.S. Cl.
CPC ..... *H01R 12/73* (2013.01); *H01R 12/7082* (2013.01); *H01R 12/714* (2013.01); *H01R 13/05* (2013.01); *H01R 2107/00* (2013.01)

(58) Field of Classification Search
CPC ..... H01R 13/052; H01R 13/17; H01R 13/18; H01R 23/725; H01R 9/097; H01R 13/05;
(Continued)

(56) References Cited

U.S. PATENT DOCUMENTS 3,847,153 A * 11/1974 Weissman ..... A61B 18/14 606/45
4,911,645 A * 3/1990 August ..... H01R 12/82 439/262
(Continued)

FOREIGN PATENT DOCUMENTS

CH 340878 9/1959
CN 101964463 2/2011
(Continued)

OTHER PUBLICATIONS

PCT International Search Report and Written Opinion for corresponding PCT Application No. PCT/EP2017/076443, dated Dec. 1, 2017, 13 pages.
(Continued)

*Primary Examiner* — Gary F Paumen
(74) *Attorney, Agent, or Firm* — Dority & Manning, P.A.

(57) ABSTRACT

In one example, the disclosure relates to plug connections of conductor tracks of at least two interspaced circuit boards with the aid of at least one plug connector. The plug connections are distinguished, for example, by the fact that the conductor tracks are easily electrically conductively interconnected. For this purpose, the plug connector can be a column having a polygonal or star-shaped or conic-section-shaped cross-section. The column can include at least two C-shaped contact springs positioned opposite each other. Moreover, the interspaced circuit boards each include, at the same point, an opening for partially accommodating the column, including plated through-holes, and so the interspaced plated through-holes of the circuit boards can be
(Continued)

electrically conductively interconnected via the contact springs of the column.

9 Claims, 1 Drawing Sheet

(51) Int. Cl.
*H01R 13/05* (2006.01)
*H01R 12/71* (2011.01)
*H01R 107/00* (2006.01)

(58) Field of Classification Search
CPC .. H01R 12/73; H01R 12/7082; H01R 12/714; H01R 2107/00
USPC ..... 439/75, 74, 246, 825, 827
See application file for complete search history.

(56) References Cited

U.S. PATENT DOCUMENTS 5,071,363 A 12/1991 Reylek et al.
5,106,310 A * 4/1992 Krajewski ..... H05K 3/368 439/75
5,567,127 A * 10/1996 Wentz ..... A47L 7/00 415/119
5,761,050 A * 6/1998 Archer ..... H01R 12/585 361/744
6,382,986 B1 * 5/2002 Kim ..... H01R 12/721 439/631
6,676,424 B2 * 1/2004 Ferranti ..... H01R 13/518 439/213
7,083,431 B1 * 8/2006 Darr ..... H01R 12/585 439/75
2003/0143881 A1 7/2003 Ferranti et al.
2012/0190219 A1 7/2012 Pai et al.

FOREIGN PATENT DOCUMENTS

DE 669220 12/1938
DE 9413196 10/1994
DE 29509987 8/1995
EP 2 889 965 7/2015

OTHER PUBLICATIONS

PCT International Preliminary Report on Patentability for corresponding PCT Application No. PCT/EP2017/076443, dated Apr. 23, 2019, 9 pages.

* cited by examiner

PLUG CONNECTION OF CONDUCTIVE TRACKS OF AT LEAST TWO MUTUALLY SPACED CIRCUIT BOARDS, BY MEANS OF AT LEAST ONE PLUG CONNECTOR

CROSS-REFERENCE TO RELATED APPLICATIONS

The present application is a 371 of International Application No. PCT/EP2017/076443 filed on Oct. 17, 2017, which claims priority to German Application No. DE102016220346.0 filed on Oct. 18, 2016 and is hereby incorporated by reference in its entirety for all purposes.

FIELD

The present disclosure relates generally to plug connections of conductor tracks of at least two interspaced circuit boards with the aid of at least one plug connector.

BACKGROUND

Plug connectors having a plug and a coupling, wherein at least one of these elements is connected to lead wires, are generally known. In this case, the plug or the coupling can also be located on a circuit board.

In addition, wireless connections are also known. For example, a miniature multiple conductor electrical connector can be used for electrically interconnecting two electrical components which have a large number of electrical terminals. The multiple conductor electrical connector can include a pair of intermeshable members. These members can have tapered elements as male tapered elements and female tapered elements, and so these can intermesh. The adhesion can be ensured via the tapered sides of the elements. In this case, essentially no tolerances of the elements with respect to one another are permitted.

The plug connectors can be situated equidistantly away from a predefined shared axis and have an axially parallel orientation with respect to this shared axis. The individual circuit boards may be no longer oriented in parallel to one another, but rather can be situated on the plug connector on a circular arc about a shared axis, equidistantly from the axis.

SUMMARY

Aspects and advantages of embodiments of the present disclosure will be set forth in part in the following description, or may be learned from the description, or may be learned through practice of the embodiments.

One example aspect of the present disclosure is directed to . . . .

These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

Detailed discussion of embodiments directed to one of ordinary skill in the art are set forth in the specification, which makes reference to the appended figures, in which.

DETAILED DESCRIPTION

Figure 1:
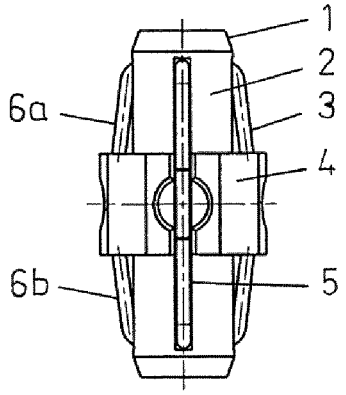
FIG. 1 shows a plug connector.

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

Example aspects of the present disclosure are directed to plug connections of conductor tracks of at least two interspaced circuit boards with the aid of at least one plug connector. A problem addressed by the example aspects of the present disclosure is that of easily electrically conductively interconnecting conductor tracks of at least two circuit boards.

In some embodiments, the plug connections of conductor tracks of at least two interspaced circuit boards with the aid of at least one plug connector are distinguished, in particular, by the fact that the conductor tracks are easily electrically conductively interconnected. For this purpose, in some embodiments, a plug connector can be a column having a polygonal or star-shaped or conic-section-shaped cross-section. The column includes at least two C-shaped contact springs positioned opposite one another. Moreover, the interspaced circuit boards each include, at the same point, an opening for partially accommodating the column, including plated through-holes, and so the interspaced plated through-holes of the circuit boards can be electrically conductively interconnected via the contact springs of the column.

The plug connection can be suited, in particular, for connecting assemblies on circuit boards which are situated one above the other. Therefore, a small installation space can be achieved, wherein a small spacing between the circuit boards is simultaneously possible. This is the case, for example, in plug or coupling housings, the bottom surface of which is limited. These plug or coupling housings can also contain sensors, and so complex electronic assemblies are also achievable. Microcontrollers, in particular, can be integrated therein, and so intelligent sensors can be easily manufactured.

The plug connector is only one part of the connection with respect to a plug-socket connection. The other part is the circuit boards themselves. No soldered joints are necessary in this case. The circuit boards can be easily assembled. The plug connector can be inserted into an opening. During the placement of the circuit board spaced apart therefrom, which includes an identical opening, conductor tracks can be automatically electrically conductively interconnected.

For this purpose, the opening and the plug connector can be designed having different cross-sections, and so forced positions are achievable. The assembly can be substantially simplified, wherein the circuit boards can be joined without force. The conductor tracks can be connected via the C-shaped contact springs in this case. For this purpose, the legs of the contact springs are arranged in the direction of the circuit board. With the aid of these contact springs, tolerances and/or position changes between the openings of the circuit boards are slightly compensated. The changes of position resulting at different temperatures can compensate one another. This also takes place, of course, in the case of thermal alternating loads. The compensation can take place in the x-direction, y-direction, z-direction, and rotational direction in this case. The contact springs can also ensure that the interconnected circuit boards remain free from force in the event of changes in position or in the case of position tolerances. In the event of a change, no further forces are applied by the plug connector except for the contact forces for ensuring the electrically conductive connection of the conductive tracks. The compensation of the contact forces can take place in each of the circuit boards per se.

The compensation in the case of changes in position and/or position tolerances between the circuit boards can take place in the longitudinal direction of the plug connection, in the transverse direction with respect thereto, and during rotations. This feature can also substantially simplify the assembly.

In addition to the compensation resulting due to thermal changes in position of the circuit boards, an error-free connection can also be ensured in the event of oscillations and the resultant movements or oscillations of the circuit boards relative to one another. In order to provide the contact reliability, reduced force can be applied onto the circuit board from the outside.

In some embodiments, the middle area of the column can be designed to be larger, in the cross-section thereof, in areas, than the end areas of the column. Moreover, the column can include grooves accommodating contact springs in parallel to the longitudinal axis of the column, and so the legs of the C-shaped contact springs point toward the outside.

The area of the column, which is larger in the cross-section thereof, can simultaneously be the particular stop of the circuit board. The spacing therebetween can be determined, in this case, by the length of the middle area of the column. The assembly of the circuit boards can be simplified.

In some embodiments, the middle area can be the holder of the particular contact spring due to press-fitting and/or bonding and/or clamping. These are fastenings which can be easily achieved.

In some embodiments, the end areas of the column include grooves, in areas, in extension of the groove of the middle area. Moreover, the continuous groove, which is present in this way, is a groove accommodating the middle area of the C-shaped contact spring, and so the contact spring is fixed on the column. The stability of the contact springs on the column can be enhanced.

In some embodiments, the middle area is the stop for the circuit boards. Moreover, the spacing between the circuit boards can be determined by the length of the middle area in the longitudinal direction of the column.

In some embodiments, the contact spring can be advantageously a leaf spring or a spring having a round cross-section. In some embodiments, the column can be made of a plastic and the contact spring is made of a metal.

A plug connection can include at least one plug connector 1 interconnecting conductor tracks of at least two interspaced circuit boards 8.

FIG. 1 shows a basic representation of a plug connector 1. The plug connector 1 is a column 2 having a circular and, therefore, conic-section-shaped cross-section. The column 2 comprises two C-shaped contact springs 3 positioned opposite one another.

Figure 2:
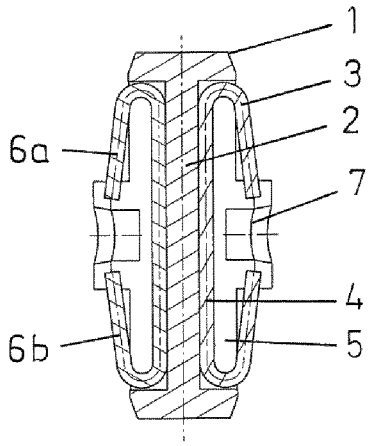
FIG. 2 shows a sectional representation of a plug connector.

FIG. 2 shows a basic sectional representation of a plug connector 1. The middle area 4 of the column 2 is designed to be larger, in the cross-section thereof, in areas, than the end areas of the column 2. The column 2 includes grooves 5 accommodating the contact springs 3 in parallel to the longitudinal axis of the column 2, and so the legs 6 of the C-shaped contact springs 3 point toward the outside. The middle area 4 is the holder of the particular contact spring 3 which is fastened with the aid of a caulking connection 7. The contact springs 3 themselves are springs having a round cross-section.

Figure 3:
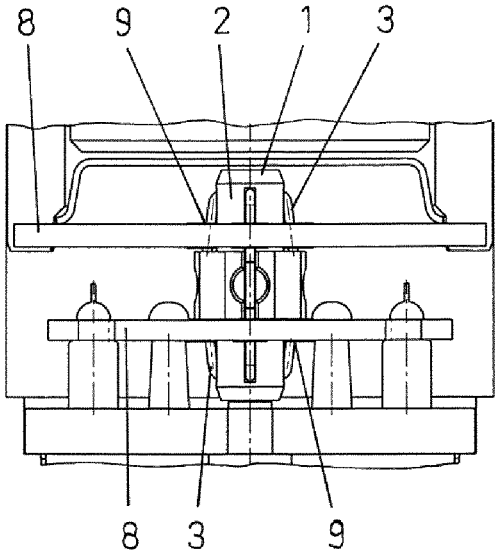
FIG. 3 shows a plug connector interconnecting conductor tracks of two circuit boards.

FIG. 3 shows a plug connector 1 interconnecting conductor tracks of two circuit boards 8. The circuit boards 8 each include, at the same point, an opening 9 for partially accommodating the plug connector 1. Plated through-holes are situated in the openings. A plated through-hole is a continuation of the conductor track of the circuit board 8, which is to be connected, on the inner wall of the opening 9. During the joining of the plug connector 1 in one circuit board 8 and the other circuit board 8 on the plug connector 1, wherein the plated through-holes are located at the points of the contact springs 3, the plated through-holes of the circuit boards 8 are electrically conductively interconnected via the contact springs 3. The middle area 4 is advantageously the stop for the circuit boards 8. In this case, the column 2 is made of a plastic and the contact springs 3 are made of a metal, in particular, spring steel having a surface finishing.

While the present subject matter has been described in detail with respect to specific example embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A plug connection of conductor tracks of at least two interspaced circuit boards, comprising a plug connector, wherein the plug connector is a column having a polygonal or star-shaped or conic-shaped cross-section, wherein the column comprises two C-shaped contact springs positioned opposite one another;

wherein the interspaced circuit boards each comprise, at the same point, an opening for partially accommodating the column, the openings comprising plated through-holes, wherein the plated through-holes of the two interspaced circuit boards are electrically conductively interconnected via the contact springs of the column.

2. The plug connection of claim 1, wherein a middle area of the column is larger in cross-section than at least one end area of the column.

3. The plug connection of claim 2, wherein the column comprises a plurality of grooves accommodating the contact springs in parallel to a longitudinal axis of the column such that legs of the C-shaped contact springs point toward the outside.

4. The plug connection of claim 1, wherein a middle area of the column is a holder of the contact spring due to press-fitting and/or bonding and/or clamping.

5. The plug connection of claim 1, wherein at least one end area of the column comprise a plurality of grooves.

6. The plug connection of claim 5, wherein at least one of the plurality of grooves extends into a middle area of the column to accommodate one of the two the C-shaped contact springs.

7. The plug connection of claim 2, wherein the middle area of the column is a stop for the two interspaced circuit boards.

8. The plug connection of claim 1, wherein at least one of the two contact springs is a leaf spring or a spring having a round cross-section.

9. The plug connection of claim 1, wherein the column is made of a plastic and at least one of the two contact springs is made of a metal.

* * * * *